United States Patent [19]

Rath

[11] Patent Number: 4,547,695

[45] Date of Patent: Oct. 15, 1985

[54] CRT SHADOW MASK ASSEMBLY

[75] Inventor: Dale R. Rath, Gales Creek, Oreg.

[73] Assignee: Tektronix, Inc., Beaverton, Oreg.

[21] Appl. No.: 471,588

[22] Filed: Mar. 3, 1983

[51] Int. Cl.[4] ..... H01J 29/07

[52] U.S. Cl. ..... 313/406; 313/407

[58] Field of Search ..... 313/407, 406, 404, 402

[56] References Cited

U.S. PATENT DOCUMENTS

| | | | |
|---|---|---|---|
| 2,611,100 | 9/1952 | Faulkner et al. | 313/92 |
| 3,358,170 | 12/1967 | Fiore | 313/406 |
| 3,449,612 | 6/1969 | Zachrich | 313/404 |
| 3,890,526 | 6/1975 | Palac | 313/408 |
| 4,333,034 | 6/1982 | Ohgoshi et al. | 313/407 |
| 4,467,242 | 8/1984 | Wilbur et al. | 313/406 |

FOREIGN PATENT DOCUMENTS

| | | | |
|---|---|---|---|
| 1114847 | 5/1968 | United Kingdom . | |
| 2001193 | 1/1979 | United Kingdom | 313/407 |
| 2079041 | 1/1982 | United Kingdom . | |

*Primary Examiner*—Palmer C. DeMeo

*Attorney, Agent, or Firm*—John D. Winkelman; Robert L. Harrington

[57] ABSTRACT

A shadow mask assembly for a cathode-ray tube. The shadow mask assembly includes a taut shadow mask membrane affixed to one edge of a closed frame. The frame is angled inwardly from the edge for increased resistance to buckling. Mounting clips generally aligned with the tube axis are secured to the frame inwardly of the outer edge and project outwardly thereof into engagement with locating holes in the envelope. The clips are deflected inwardly behind the outer edge for disengagement and to permit assembly of the shadow mask into an envelope having an inside dimension close to the outside dimension of the frame.

10 Claims, 3 Drawing Figures

CRT SHADOW MASK ASSEMBLY

FIELD OF THE INVENTION

This invention relates to an improvement for a shadow-mask type cathode-ray tube, and more particularly to the mounting assembly for the shadow mask.

BACKGROUND OF INVENTION

The cathode-ray tube of the present invention includes a multicolor cathodoluminescent display screen, a plurality of electron beam sources, and is used in association with a scanning system that controllably directs the electron beams toward the display screen. The beams are projected through a multiapertured shadow mask positioned between the electron beam sources and the display screen. The beam paths through the mask are such that each beam impinges upon and excites only one type of color phosphor material in the screen.

The shadow mask is a very precisely constructed, very precisely positioned component of the cathode-ray tube. It consists of a membrane of electron beam absorbing material with a very closely patterned array of holes. These holes are required to be accurately aligned between the electron beam sources and specific groups of dots of phosphor on the display screen so as to permit passage only of the particular beam that is intended to address a designated phosphor dot. Any portion of the beam that would fall outside the dot area is intercepted and absorbed by the membrane material.

The mounting structure for the shadow mask of the contemplated cathode-ray tube includes a closed frame over which the membrane is stretched and securely fastened. The frame must be substantially rigid to avoid any buckling due to the tension of the membrane, and it must be securely mounted in the envelope of the cathode-ray tube in a manner that will resist distortion due to vibration.

Prior to the present invention, shadow mask frames typically have been formed by a continuous strip of rigid material with inwardly directed flanges along each edge. The flanges provided stiffening of the structure and one flange provided the surface to which the membrane was attached. Spring biased clips were welded to the outer side of the strip and were adapted to fasten in a precise manner to the envelope of the cathode-ray tube.

It is an objective of the present invention to maximize the display area of the display screen relative to .the overall dimension of the tube. This is important in a number of applications, as for example where a number of cathode-ray tube displays are required in a restricted panel area, e.g., the instrument panel in the cockpit of an airplane. It will be understood that the display area of a cathode-ray tube incorporating the above-described prior shadow mask frame structure was restricted by the width of the flange to which the membrane was attached and by the location of the mounting clips between the frame and the envelope. Thus it is a specific objective of this invention to provide a rigid frame for the shadow mask membrane with reduced flange width. Still further, it is an objective of this invention to provide a mounting structure that does not require space between the frame and the cathode-ray tube envelope.

SUMMARY OF THE INVENTION

The present invention includes a closed strip of rigid material having outwardly directed flanges along each edge for stiffening. The membrane is stretched over the frame and attached to one of the flanges. The strip is inwardly angled from the membrane to the extent permitted without intefering with the electron beams projected toward the outermost edge of the membrane (where it attaches to the flange). This angle increases the moment of inertia, i.e. the resistance to the buckling force induced by the taut membrane. Note that the buckling force is partially directed to compress the strip rather than simply being directed to bend the strip. The strip is far more resistant to being compressed than to being bent. Thus the need for the flanges is reduced and the width can be shortened without affecting the resistance to buckling.

The mounting clips are mounted to the frame inwardly from the flange to which the membrane is attached. Locating buttons attached to the clips are adapted to engage locating recesses in the sidewalls of the cathode-ray tube envelope. The clips are spring biased to urge the buttons into engagement with the recesses but can be deflected to withdraw the buttons behind the flange. Thus the shadow mask frame can have an outer dimension, i.e. the outer dimension of the flange to which the membrane is attached, that closely matches the inside dimension of the envelope.

The modified frame also permits a preferred mounting arrangement for the clips. The clips are leaf springs that are anchored at one end to the frame adjacent the inner edge of the strip and are projected towards the outer edge, i.e. in a direction generally parallel with the axis of the tube. Such clips when engaged with the housing recesses, strongly resist side movement and to a lesser extent axial movement. There are four clips, one for each side of the tube, and all four cooperate to resist axial movement and in pairs resist side movement. This arrangement is preferred to achieve optimum resistance to distortion of the image, e.g. due to vibration.

DETAILED DESCRIPTION INCLUDING DRAWINGS

The above brief description of the preferred embodiment will be more clearly understood by reference to the detailed description that follows and by reference to the drawings wherein.

Figure 1:
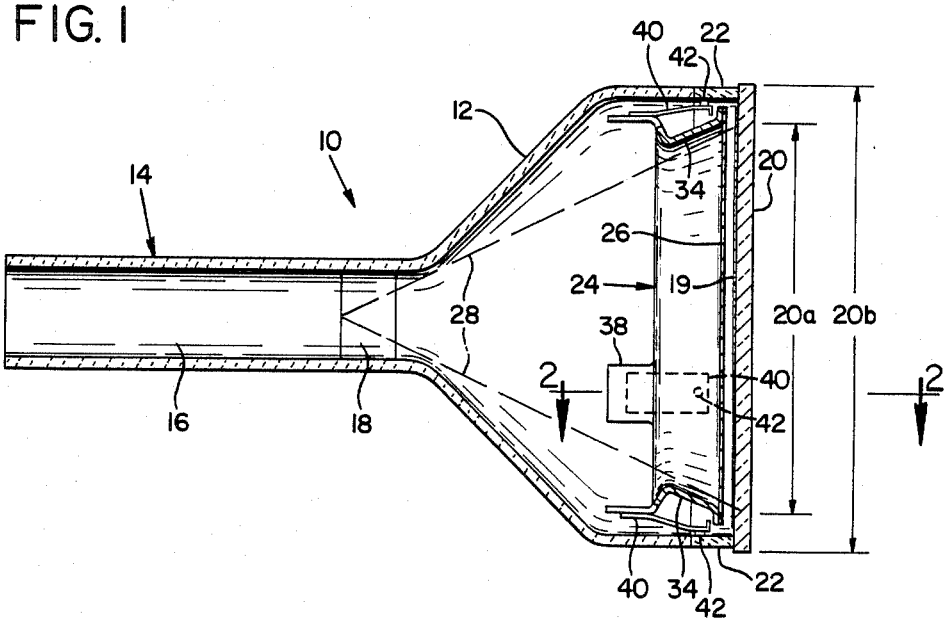
FIG. 1 illustrates a cathode-ray tube including the improved shadow mask frame assembly of the present invention.

Referring to the drawings, a cathode-ray tube 10 comprises an envelope 12 having a neck portion 14 that houses a plural electron beam source (in the area 16), suitably comprising a cluster of three electron guns. An associated electron beam scanning system, including an external magnetic deflection yoke (not shown), acts on the beams in region 18 of the tube. A display screen 19 is provided on the inner surface of a faceplate panel 20 having a flange 22 that mates with the envelope 12 to form an airtight cavity. Mounted inside the envelope, is a shadow mask assembly 24 including a shadow mask membrane 26 that is positioned adjacent display screen 19.

The shadow mask assembly 24 consists of a rigid metal strip that is formed into a four sided closed frame 30. An outwardly directed flange 32 is provided along one edge of the strip 30 and a second outwardly directed flange 36 is provided along the other edge. The shadow mask membrane 26 is stretched over the frame 30 and secured, as by welding, to the flange 32 of the frame 30. As will be particularly noted by reference to FIG. 2, the intermediate portion 34 of the rigid strip is angled inwardly from the edge in which flange 32 is formed, to the edge in which flange 36 is formed. This angle alpha ($\alpha$) is established to coincide with the angle of deflected electron beam 28 where the beam passes through the outermost edge of the shadow mask membrane, i.e. the junction of the membrane with flange 32. This angle ensures that the main body portion of the frame 30 will not interfere with the electron beam projection.

Referring now to the means for mounting the shadow mask assembly to the faceplate panel, ears 38 extend from flange 36 on each of the four sides of frame 30. A leaf spring 40 is anchored, as by welding, to each ear 38 and projected toward flange 32, but just short of the flange 32 as illustrated. A locating button 42 is provided on the projected end of the leaf spring 40.

Figure 3:
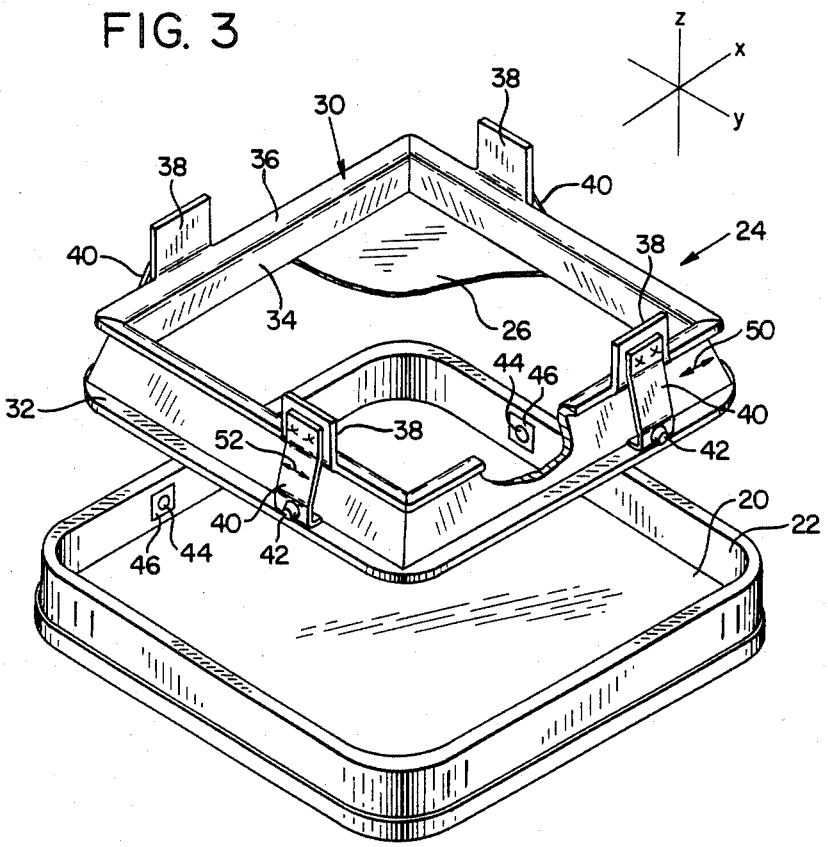
FIG. 3 is a perspective view illustrating the shadow mask assembly and display screen prior to assembly.
Figure 2:
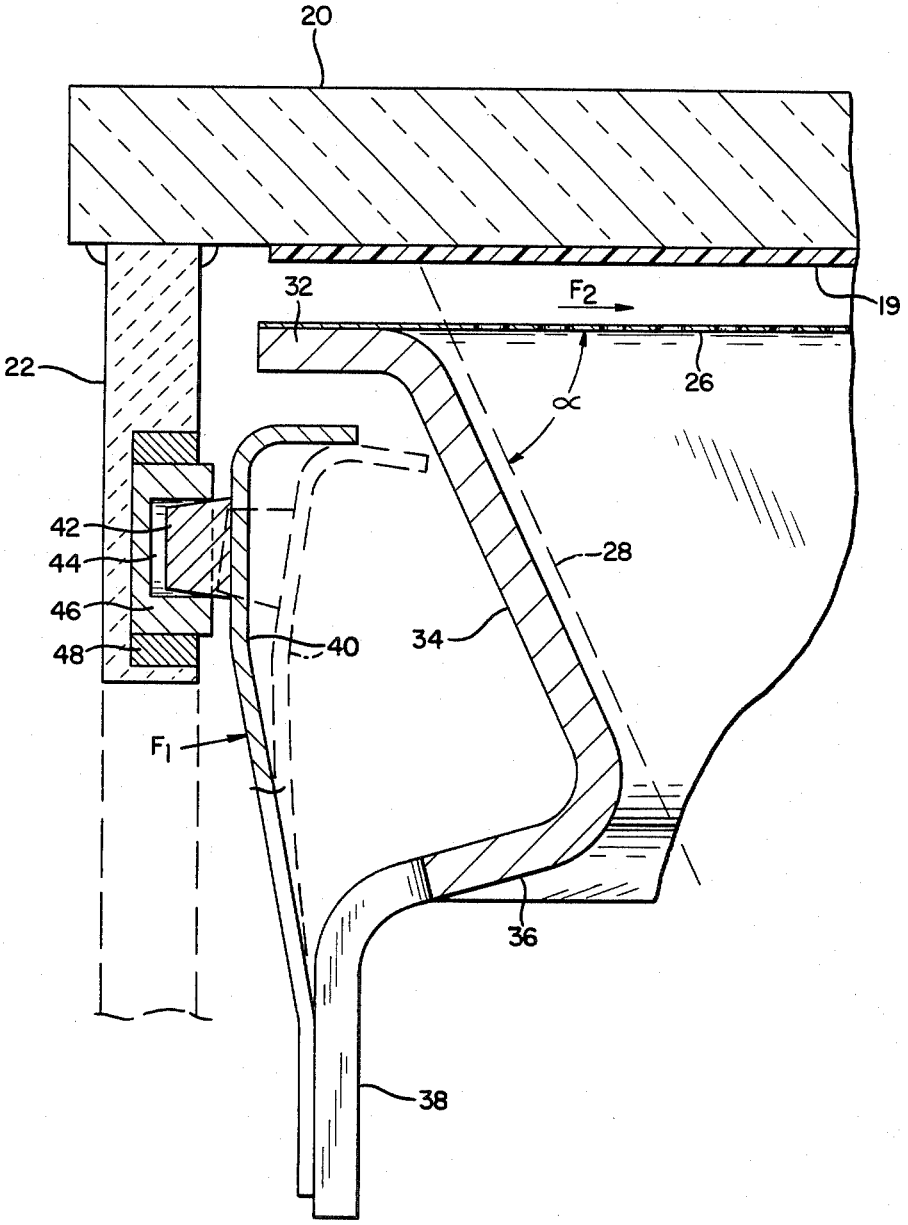
FIG. 2 is an enlarged view illustrating the mounting features of the shadow mask frame assembly taken on section lines 2—2 of FIG. 1.

Referring specifically to FIGS. 2 and 3, the faceplate panel 20 is provided with flange 22 as previously explained. A metal insert 46 is attached to the inside of the flange 22 as by providing a cavity in the flange and bonding the insert 46 within the cavity with a bonding material 48. A locating recess 44 is provided in the insert 46 to mate with the button 42. As shown, the button 42 is tapered and the recess 44 is straight so that the button, by urging of the leaf spring 44, is firmly seated in the recess to eliminate play.

As briefly explained in the Brief Description of the Invention, a major advantage of the above-described embodiment is the generous display area 20*a* that is provided relative to the outer dimensions 20*b* of the cathode-ray tube envelope. By angling the body portion 34 of the rigid strip to follow the outermost path of a deflected electron beam 28, the frame 30 has improved stiffness as concerns the inwardly directed force $F_2$ exerted by the taut membrane 26, and the flange 32 can be accordingly shortened.

The width of flange 32 depends on the type of material used, the overall dimensions of the frame, the tension created in the membrane, etc. For any given application, a technician will be able to determine these factors and calculate the required width of the flange. Furthermore, for any such given application, he or she will be able to determine the angle permitted for portion 34, calculate the benefit of the angle (a contributory to the moment of inertia) and accordingly reduce the width of flange 32. It follows, that the non-functional area of the display screen is accordingly reduced.

It will be realized that the same angle alpha ($\alpha$) that generates improved stiffening of the frame, also generates a relief area around the frame 30 (under flange 32) in which the clips 40 can reside. As can be seen by reference to FIG. 2, the leaf spring 40 normally biases the button 42 outwardly of flange 32 and into engagement with the locating recess 44. However, upon deflection of the spring 40 through application of a force $F_1$, the spring and button are drawn into the relief area as shown in phantom lines in FIG. 2. Thus the shadow mask assembly can be assembled and disassembled without a peripheral spacing allowed for the clip. The inner dimension of the cathode-ray tube envelope can be closely matched to the outer dimension of the frame 30 (as determined by flange 32) and again the non-functional area of the display screen 19 is reduced when compared to prior structures.

Heretofore the combination button-recess arrangement for positioning the shadow mask assembly in the envelope has been accomplished with a ceramic button on the envelope and a metal recess in the clip. The metal caused rapid wearing of the button which is undesirable. In the above, the metal insert 46 has a metal form recess 44 that matches the metal of button 42 to alleviate this wearing problem.

Referring now to FIG. 3 and the axis diagram which accompanys that figure, it will be appreciated that vibration and shock forces are exerted on the assembly in all three directions X, Y and Z. The clips 40 are especially designed to resist side movement which is that movement suggested by arrows 50 and 52 in FIG. 3, i.e. in the X and Y directions. The clips are also resistant to lengthwise movement, i.e. in the Z direction but not to the same degree. Note that movements in the X and Y directions (where resistance is greatest) are each resisted by two of the clips 40, while all four clips cooperate to resist movement in the Z direction. This achieves the optimum balance of resistance to vibration forces.

It will be understood that the above description is specifically directed to a preferred embodiment of the invention. In furtherance of this specific description, it will be appreciated that the clips or leaf springs 40 are preferably made of a beryllium nickel allow such as alloy 440, available from Kaweiki Berylco Industries. This material has high strength and is resistant to high temperatures while maintaining its spring properties at elevated temperatures. It is also easily weldable to the frame material. The coefficient of expansion of the material of the metal insert 46 is closely matched to the material of the envelope, an example of which is a nickel iron alloy, Niron 52 available from the Amex Company. The material of the frame 30 is matched to the ceramic of the flange 22 which is matched to the leaded glass of the screen 20. The preferred material is Carpenter 42, an alloy from Carpenter Steel Co.

All of the above preferences may be departed from and perhaps improved upon by others having exposure to the invention. Such departures and improvements are considered within the concept of the invention as determined by the appended claims.

I claim:

1. A shadow mask assembly for a cathode-ray tube comprising a closed frame and a shadow mask membrane attached to the frame in a taut condition whereby an inwardly directed bending force is exerted on the frame, characterized by a rigid strip of material forming the main body of the frame, the membrane being affixed to one edge of the strip, said strip being angled from said one edge inwardly toward the other edge whereby said bending force is partially directed to compress the strip, said strip including an outwardly directed first flange formed at said one edge, the membrane being attached to said first flange, and a second outwardly directed flange formed at said second edge, said flanges enhancing the rigidity of the strip to resist bending.

2. A shadow mask assembly for a cathode-ray tube as defined in claim 1 wherein mounting means are provided for mounting the shadow mask assembly in the cathode-ray tube, said mounting means including a plurality of leaf springs having one end attached to the frame adjacent the second edge and projecting toward said first edge and terminating short of the first flange, an outwardly directed locating button provided on the projected end of the leaf spring adapted to engage a locating recess in the housing of the cathode-ray tube, said leaf spring biased outwardly to locate the button outwardly of the first flange and adapted to be deflected substantially inwardly to locate the button inwardly of the first flange.

3. A shadow mask assembly as defined in claim 2 wherein the frame has four sides and a leaf spring mounting means is provided at each of the four sides to provide a balanced resistance to movement of the assembly relative to the cathode-ray tube envelope.

4. A shadow mask assembly as defined in claim 2 wherein a leaf spring mounting means includes an ear portion extended from the second edge of the strip, said leaf spring anchored to the ear portion to provide added length to the leaf spring and easier deflection thereof.

5. A cathode-ray tube including a faceplate panel having a flange portion forming part of the envelope of the tube, a display screen provided on the inner surface of the panel, and a shadow mask assembly mounted to said flange in close proximity to the display screen, said assembly including a closed, substantially rigid frame, a shadow mask membrane attached to the frame in a taut condition, and mounting means for mounting the assembly to the flange of the faceplate panel, characterized in that the main body of the frame is formed of a strip of substantially rigid material having an outwardly directed flange at each edge, the membrane is affixed to the flange at one edge of the strip, and the portion of the strip intermediate said flanges angles inward from the edge to which the membrane is affixed, whereby bending forces induced by the taut membrane are partially directed to compress the strip.

6. A cathode-ray tube as defined in claim 5, wherein said mounting means includes a plurality of leaf springs having one end anchored to the frame adjacent said other edge and projected toward said one edge and terminating short of said one edge, a locating button on the free end of the spring, said leaf spring biased outwardly to locate the button outwardly of the one edge and said leaf spring adapted to be deflected inwardly to locate the button inwardly of said one edge, and a button receiving recess on the inside of the flange of the faceplate panel adapted to receive the button of the leaf spring and thereby locate the shadow mask assembly relative to the display screen.

7. A cathode-ray tube as defined in claim 6, wherein the button receiving recess is a metal insert bonded to the flange of the faceplate panel.

8. A cathode-ray tube as defined in claim 5, wherein the angle of said intermediate portion of the strip substantially matches the deflection angle of an electron beam directed toward the outermost edges of the display screen.

9. A shadow mask assembly for a cathode-ray tube, comprising a mask membrane, and a frame on which the membrane is mounted, said frame comprising a substantially rigid strip of material configured in a closed loop, the strip having an outwardly projecting first flange portion at one edge, an outwardly projecting second flange portion at the opposite edge, and an intermediate web portion that angles inwardly from the first to the second flange portion, said membrane being secured to said first flange portion in a taut condition, thereby exerting an inwardly directed force on the flange that enhances the rigidity of the frame.

10. The shadow mask assembly of claim 9, further comprising means on said frame for mounting the assembly within a cathode-ray tube, said means including a plurality of elongate spring members attached to the frame adjacent said second flange portion and projecting toward said first flange portion, each of the spring members being provided with means for engaging the inner wall of said cathode-ray tube to hold the assembly in position within said tube.

* * * * *